US005884340A

United States Patent [19]

Chen et al.

[11] Patent Number: 5,884,340

[45] Date of Patent: Mar. 23, 1999

[54] SHIELD OR LIKE CLOTHING ARTICLE

[76] Inventors: Chun Nan Chen, P.O. Box 15316; Chung Chin Chen, P.O. Box 15316, both of Arlington, Va. 22215

[21] Appl. No.: 933,928

[22] Filed: Sep. 19, 1997

[51] Int. Cl.[6] ..... A41D 13/00

[52] U.S. Cl. ..... 2/455; 2/463; 2/466; 2/267; 89/36.01; 450/57

[58] Field of Search ..... 2/1, 455, 459, 2/460, 461, 462, 463, 464, 468, 466, 467, 69, 69.5, 22, 23, 24, 46, 16, 20, 300, 312, 313, 315, 316, 317, 318, 267; 450/30, 31, 32, 53, 54, 55, 56, 57; 89/36.05, 36.06, 36.07, 36.08, 36.01

[56] References Cited

U.S. PATENT DOCUMENTS

| | | | |
|---|---|---|---|
| 204,088 | 5/1878 | Rawson . | |
| D. 233,633 | 11/1974 | Burkard . | |
| 1,583,181 | 5/1926 | Rubio | 2/24 X |
| 1,599,762 | 9/1926 | Guthrie et al. . | |
| 1,720,439 | 6/1929 | Richardson . | |
| 1,840,621 | 1/1932 | Dwyer . | |
| 1,955,523 | 4/1934 | Yerkes . | |
| 2,319,292 | 5/1943 | Boggs . | |
| 2,534,934 | 12/1950 | Viniegra . | |
| 2,626,394 | 1/1953 | Davis | 2/24 |
| 3,161,932 | 12/1964 | Russell . | |
| 3,176,686 | 4/1965 | Barnes | 2/466 X |
| 3,339,208 | 9/1967 | Marbach . | |
| 4,122,849 | 10/1978 | Dietz . | |
| 4,835,821 | 6/1989 | Durante . | |
| 5,727,260 | 3/1998 | Torch et al. | 2/455 |

FOREIGN PATENT DOCUMENTS

| | | | |
|---|---|---|---|
| 2600900 | 1/1988 | France | 2/22 |

*Primary Examiner*—Jeanette Chapman

[57] ABSTRACT

This invention comprises mainly a first strap, belt, or the like encircling one of the legs of the wearer, at least one first shield for covering and/or supporting a private part of the wearer, and a connecting element for connecting the first shield to the first strap or belt or the like. The invention can furthermore comprise a second strap which, with one end thereof connected to the first strap, the belt or the like encircling the leg, with the other end encircling a neck, attached to an upper arm, attached (with a hook-shaped portion) to a shoulder, or attached to the first strap after passing over the front side of body, a shoulder, and the rear side of the body. A second shield for covering and/or supporting the breasts of a wearer (particularly female wearer) can be fixedly or removably attached to the second strap. The first shield can be attached to the first strap directly or through the connecting element.

13 Claims, 2 Drawing Sheets

FIG. 10
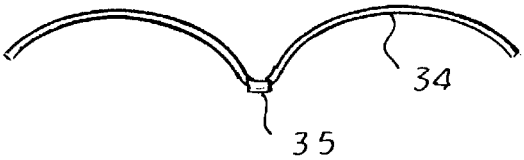
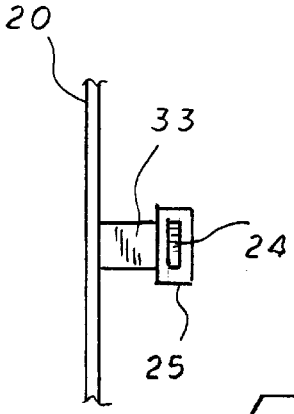
FIG. 8
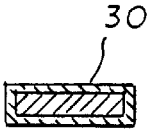
FIG. 9
FIG. 11
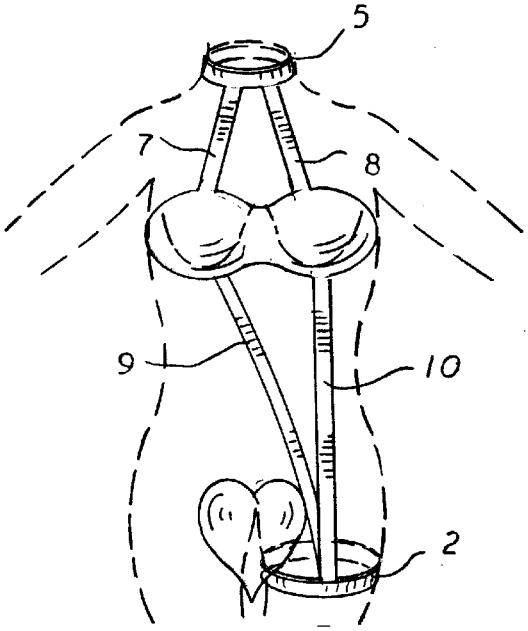
FIG. 12
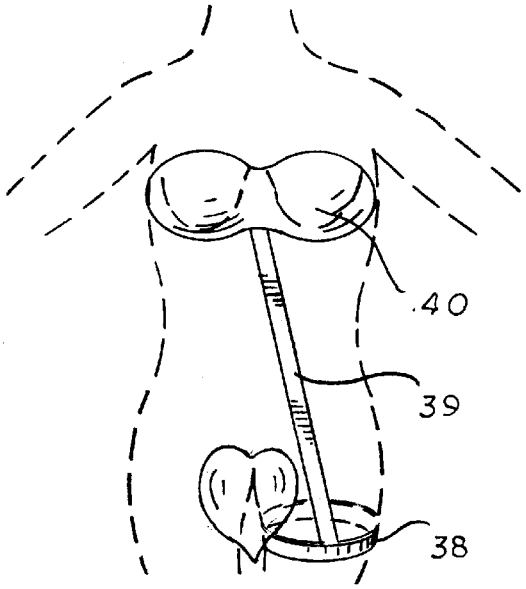

SHIELD OR LIKE CLOTHING ARTICLE

FIELD OF THE INVENTION

The present invention relates to a shield or like clothing article, particularly to a comfortable shield which can be easily worn or taken off.

BACKGROUND OF THE INVENTION

There are some garments, shields, or underwear, that people can wear, e.g.

(1) Yerkes' U.S. Pat. No. 1,955,523 discloses brassieres;
(2) Rawson's U.S. Pat. No. 204,088 shows a suspensory bandage;
(3) Richardson's U.S. Pat. No. 1,720,439 depicts a groin protector;
(4) Guthrie et al U.S. Pat. No. 1,599,762 illustrates an abdominal belt;
(5) Dwyer's U.S. Pat. No. 1,840,621 shows a suspensory and the like;
(6) Marbach's U.S. Pat. No. 3,339,208 depicts a bathing brief or the like clothing article;
(7) Viniegra's U.S. Pat. No. 2,534,934 illustrates a strapless supporter or shield;
(8) Russell's U.S. Pat. No. 3,161,932; and
(9) Boggs' U.S. Pat. No. 2,319,292 illustrate garments using magnetic fasteners;
(10) Burkard's U.S. Pat. No. Des. 233,633; and
(11) Dietz's U.S. Pat. No. 4,122,849 disclose cup supporters for the male vital parts.

People wish to feel relaxed at home. The main purpose of the present invention is to provide a novel shield or the like clothing article that people can comfortably wear and feel relaxed at home while preserving some privacy.

This invention provides a variety of shields or like clothing articles for people to choose from so as to keep life at home vivid instead of monotonous.

The shields or like clothing of this invention is particularly suitable for single people or a couple living together because some parts of the body of the people wearing the same sometimes may be exposed.

SUMMARY OF THE INVENTION

This invention comprises mainly a first strap, belt, or the like encircling one of the legs of the wearer, at least one first shield for covering and/or supporting a private part of the wearer, and a connecting element for connecting the first shield to the first strap or belt or the like.

The invention can furthermore comprise a second strap which, with one end thereof connected to the first strap, the belt or the like encircling the leg, with the other end encircling a neck, attached to an upper arm, attached (with a hook-shaped portion) to a shoulder, or attached to the first strap after passing over the front side of body, a shoulder, and the rear side of the body. A second shield for covering and/or supporting the breasts of a wearer (particularly female wearer) can be fixedly or removably attached to the second strap. The first shield can be attached to the first strap directly or through the connecting element.

A pocket for receiving some articles (e.g. keys, condoms) can be attached to the first or the second strap.

These and some other features of this invention will be better understood when the following detailed description is read in conjunction with the accompanying drawings wherein:

BRIEF DESCRIPTION OF THE DRAWINGS

FIG. 8 is an enlarged view showing the relative position of a second strap, a support arm, an adjustable arm, and a connecting element;

FIG. 9 shows a cross-sectional view of a movable piece;

FIG. 10 is an enlarged view of a reinforcing element for a shield;

FIG. 11 shows yet another embodiment of the invention; and

FIG. 12 shows a further embodiment of the invention.

DESCRIPTION OF PREFERRED EMBODIMENTS

Figure 1:
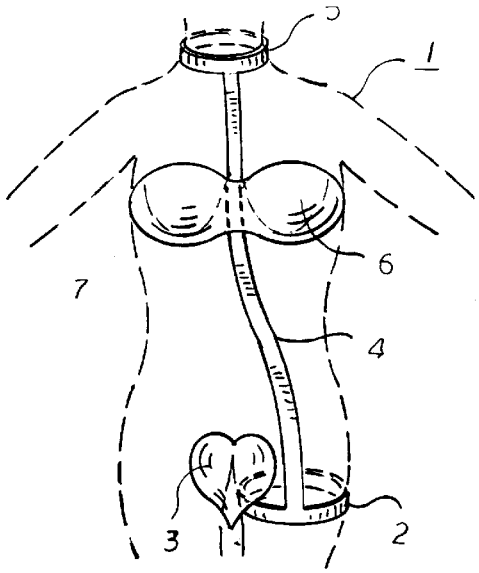
FIG. 1 is a perspective view of a first embodiment of the invention.
Figure 5:
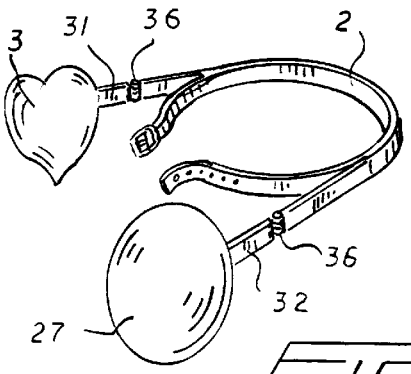
FIG. 5 shows an enlarged view of an example of a first strap with a front first shield and a rear first shield.

Referring now to FIG. 1, numeral 1 generally designates the approximate shape (outline) of the main part of a human body (in broken lines). The shield or like clothing article can comprise a first strap 2 encircling a leg portion (preferably upper leg portion), and at least a first shield 3 formed integrally with the first strap 2 or, as shown in FIG. 5, connected to the first strap 2 through a connecting element 31. This embodiment can further comprise a rear first shield 27 (FIG. 5) which can be formed integrally with the first strap 2 or connected to the first strap 2 through a connecting element 32. The shield 27 is mainly for covering the anus and nearby area. The combination of a first strap encircling a leg and at least one first shield attached directly or indirectly to the first strap forms a basic portion of this invention.

A second strap 4 can be connected with one end thereof to the first strap 2, with the other end thereof forming a neck strap 5 encircling a neck. The neck strap 5 can be formed integrally and of longer length than that shown in FIG. 1 so as to pass over a wearer's head. The neck strap 5, the first strap 2, and strap 15 (FIG. 2) can be a closed and can also be an open loop, and with ends thereof attached to each other with fastening means such as a button, Velcro® (hooks and loops), at least a pair of magnets (such as those shown in Russell's U.S. Pat. No. 3,161,932 or Boggs' U.S. Pat. No. 2,319,292), a clip, a hook and eye fastener, or the like if they are open loops.

A second shield 6 can be formed integrally with the second strap 4 or removably or fixedly attached thereto by means of Velcro®, buttons, adhesives, adhesive tapes, sewing, clips, magnets, buckles, or the like. The connection between the straps, the shields, and the connecting elements can also use the above means. The shields 3, 6, 27, etc. in this invention can be a piece of fabric, paper, plastic, metal, a leaf, a strap, a fishnet structure, a shape of a flower, animal or other decoration, or the like. It can conform to the contour of the breast or it can be a brassiere without a strap, if necessary. A reinforcing element 34 can be attached to the second shield 6 (preferably at the upper inside edge thereof), with a face 35 connecting with the second strap 4. The shields 3 and 27 can also have similar reinforcing elements attached thereto. The straps, the connecting elements, and the shields in this invention can use air-permeable or airtight material, transparent, or semi- or non-transparent material, soft, or semi-rigid, or slightly flexible, or rigid material, elastic or non-elastic material, according to the needs and options. Disposable material can also be used.

In FIG. 11, straps 7, 8, 9, and 10 can replace the second strap 4 shown in FIG. 1.

Figure 2:
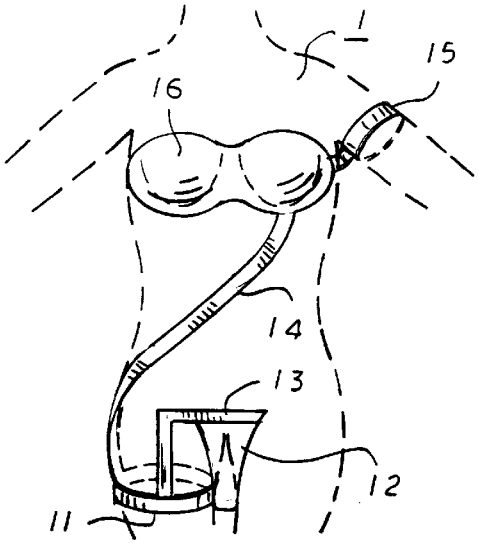
FIG. 2 is a perspective view of a second embodiment of the invention.
Figure 6:
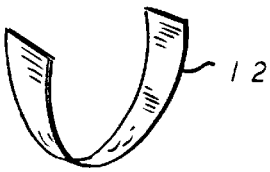
FIG. 6 shows another example of the first shield.
Figure 7:
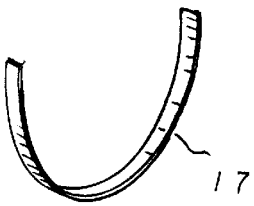
FIG. 7 shows a third example of the first shield.

Please refer to FIG. 2. A first strap 11 is connected with a second strap 14 which is connected with a second shield 16. An arm strap 15 encircling an arm (preferably upper portion) is connected to the second shield 16. A connecting element 13 (preferably made of rigid or semi-rigid material) is attached to the strap 11 or formed integrally therewith. A first shield 12 (FIG. 6) can be attached to the connecting element 13 or formed integrally therewith. The first shield 12 can be a piece of fabric, paper, or an absorbent pad for catamenial or incontinence purpose, or the like. The shields in this invention can also be formed of holes and/or slits. A so-called G-string 17 (FIG. 7) can also be attached to the connecting element 13 (to replace the shield 12). The two ends of the shield 12, G-string 17 or a pad can contact the skin directly or be kept a distance from the skin. In FIG. 2, at the rear side, a rear connecting element 13 (not shown) symmetrical to the front element 13 is provided to attach a rear end of the shield 12. The shields similar to those shown in Viniegra's U.S. Pat. No. 2,534,934 or Marbach's U.S. Pat. No. 3,339,208 can also replace the shield 12.

Figure 3:
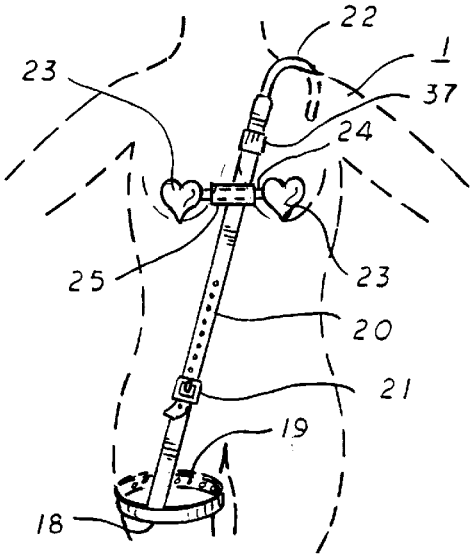
FIG. 3 is a perspective view of a third embodiment of the invention.

Please refer to FIG. 3 which shows an example of "one size fits all." A first shield is not shown in FIG. 3. A first strap 18 is provided with a plurality of holes 19 so that a lower end of a second strap 20 can be selectively attached to one of the holes 19 with a button, a hook (not shown in the drawing), or the like. The strap 20 is provided with a mechanism 21 for adjusting the length of the strap 20. A hook-shaped portion 22 is connected with the upper end of the strap 20 for being attached to a shoulder of the wearer. The hook shaped portion 22 can be covered with a fabric or provided with a cushion between the skin and the portion 22 to enhance comfortability. A hook shaped portion similar to portion 22 can be provided to replace the neck strap 5 shown in FIG. 1. Please refer to FIGS. 8 and 3, a support arm 25 is attached to the second strap 20 with a connecting element 33 which preferably has a "height" (the length between the strap 20 and the arm 25) which is about the same as the "height" of the breast. Two adjustable arms 24 are frictionally slidably received in the arm 25 so as to adjust the position of the two second shields 23 so that the shields 23 can cover preferably the nipples of the breast. The mechanism (i.e., the adjustable arms 24 and the support arm 25) can be of other structure; e.g., other telescopic structures or the like. The mechanism 21 for adjusting the length of the strap 20 can be other kinds of mechanisms (e.g., those shown in class 2, subclass 325, and class 450, subclass 63), and can be used on any straps in this invention.

Figure 4:
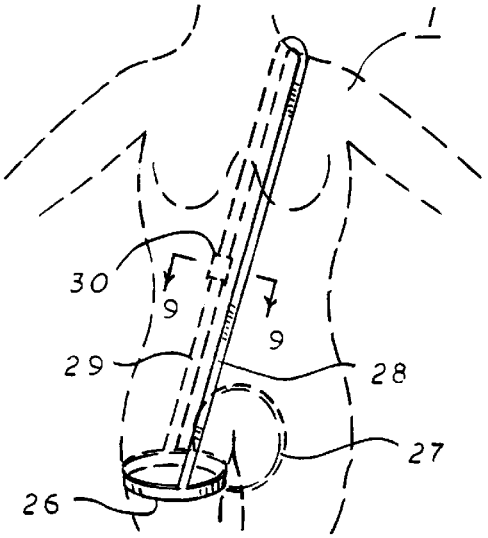
FIG. 4 is a perspective view of a fourth embodiment of the invention.

FIG. 4 shows the fourth embodiment of the invention in which a first strap 26 is attached with a rear first shield 27 (the front shield is not shown in the drawing), a front second strap 28, and a rear second strap 29. A movable piece 30 is frictionally slidably provided on the strap 28 so as to adjust the position of a second shield (not shown in the drawing) which is attached to the movable piece 30. A clip or the like can be used to replace the movable piece 30.

The preferred embodiments are described hereinabove. Various changes in form and detail can be made without departing from the spirit and scope of the claimed invention. For example, the first strap in the invention can be an upper edge at the upper leg portion of a long stocking or hosiery; the straps shown in the figures can incorporate shields in other figures when necessary; the first strap can be on either leg or both legs; the second strap can be supported with a hat, cap, headband, or a scarf instead of the neck, arm, or shoulder; the front first shield can be a cup similar to those shown in Burkard's U.S. Pat. No. Design 233,633 or Dietz's U.S. Pat. No. 4,122,849; the straps and the shields can be personalized (e.g., printed or written with name, words, and/or pictures), or of other shapes (e.g., flowers, animals, etc.); an electromagnetic device which is controlled by sound or the like can be used for controlling the opening of the straps; a circular band of loops or hooks of a Velcro® can be provided around the outer face of the shield 16 of FIG. 2 for attaching a piece of hooks or loops attached on the inner face of the upper end of the strap 14 and the lower end of the strap 15 so as to adjust the relative position of the straps 15 and 14 and the shield 16. The straps 15 and 14 can also be attached to the shield 16 with clips or other means. The connecting elements 31 and 32 can be provided with a "hinge"-like structure (e.g., 36 in FIG. 5) so that the shields 3 and 27 can be turned to a different position. The elements 31 and 32 (FIG. 5) can also be without the hinges 36. The positions of the hinges can be different from that shown in FIG. 5. The elements 31 and 32 can also be provided with a structure similar to arms 24 and 25 (FIGS. 3 and 8), or other structures so as to adjust the length thereof and the position of the shields 3 and 27. In FIG. 5, the two ends of the strap 2 also can be attached with a button, Velcro®, an adhesive tape, or the like. A pocket 37 can (FIG. 3) can be attached to a second strap 20 or a first strap for receiving some articles (e.g., keys, condoms).

We claim:

1. A clothing article, comprising mainly a first strap encircling completely a section of a leg of a wearer, and a first shield connected with the first strap for covering a genital area of the wearer, further comprising a second strap connected with the first strap, and a second shield connected with the second strap for covering a chest area of the wearer.

2. A clothing article, as in claim 1, wherein the second strap is supported by a neck of the wearer.

3. A clothing article, as in claim 1, wherein the second strap is supported by a shoulder of the wearer.

4. A clothing article, as in claim 1, wherein the second strap is supported by an arm of the wearer.

5. A clothing article, as in claim 1, wherein the second strap is connected to the second shield through a connecting element.

6. A clothing article, as in claim 1, wherein the lengths of the first and second strap are adjustable.

7. A clothing article, as in claim 5, wherein the length of the connecting element is adjustable.

8. A clothing article, as in claim 1, wherein the second shield comprises two parts which are connected with a connecting element.

9. A clothing article, as in claim 8, wherein the connecting element is adjustable in length.

10. A clothing article, as in claim 1, wherein the position of the second shield is adjustable.

11. A clothing article, as in claim 1, further comprises a pocket connected to the first and second straps.

12. A clothing article, as in claim 1, wherein the second strap is self-supporting.

13. A clothing article, comprising mainly a first strap encircling completely a section of a leg of a wearer, and a first shield connected with the first strap for covering a genital area of the wearer, wherein the first shield further includes a rear portion for covering an anus and nearby area of the wearer.

* * * * *